US005426480A

United States Patent [19]

Sawada et al.

[11] Patent Number: 5,426,480

[45] Date of Patent: Jun. 20, 1995

[54] PHOTOGRAPHIC FILM PROCESSING APPARATUS

[75] Inventors: Ryosaku Sawada; Kensaku Sawada; Kosaku Sawada; Sosaku Sawada; Mikio Matsui, all of Nishinomiya, Japan

[73] Assignee: Hanshin Technical Laboratory, Ltd., Nishinomiya, Japan

[21] Appl. No.: 241,576

[22] Filed: May 12, 1994

[30] Foreign Application Priority Data

Jun. 15, 1993 [JP] Japan ..... 5-143678

[51] Int. Cl.[6] ..... G03D 3/08; G03D 13/02

[52] U.S. Cl. ..... 354/320; 354/331; 354/336

[58] Field of Search ..... 354/319–324, 354/331, 336; 134/122 P, 112 R, 64 P, 64 R

[56] References Cited

U.S. PATENT DOCUMENTS 3,057,282 10/1962 Luboshez ..... 354/305
4,324,479 4/1982 Sachs ..... 354/319
5,182,593 1/1993 Fischer ..... 354/322

FOREIGN PATENT DOCUMENTS 4-62657 10/1992 Japan .
4-62658 10/1992 Japan .
5-188559 7/1993 Japan .

*Primary Examiner*—D. Rutledge
*Attorney, Agent, or Firm*—Oblon, Spivak, McClelland, Maier & Neustadt

[57] ABSTRACT

A photographic film processing apparatus comprises a water tank for containing a constant quantity of fresh water, and one or a plurality of processing units each comprising a pair of feed rollers disposed with their circumferences in close contact with each other, a pair of delivery rollers spaced apart from the pair of feed rollers and disposed with their circumferences in close contact with each other, a pair of sealing rollers disposed with the circumference of one of them in close contact with the circumferences of the top feed roller and the top delivery roller and with the circumference of the other in close contact with the circumferences of the bottom feed roller and the bottom delivery roller, and a pair of support plates disposed respectively on the opposite sides of the rollers so as to support the rollers for rotation and to define a liquid-tight processing chamber by the circumferences of the rollers and the inner surfaces thereof. The processing unit or units are immersed completely in fresh water contained in the water tank, and a processing liquid is circulated through each processing chamber, at a high velocity across the direction of travel of a film in the processing chamber.

10 Claims, 5 Drawing Sheets

PHOTOGRAPHIC FILM PROCESSING APPARATUS

BACKGROUND OF THE INVENTION

1. Field of the Invention

The present invention relates to a photographic film processing apparatus for processing medical, industrial and general-purpose photographic film, radiographic films, or printing paper.

2. Description of the Related Art

Generally, in a dental clinic or research laboratory, an exposed photographic film or radiographic film (hereinafter referred to simply as "film") is immersed in a developing solution contained in a processing container for developing, the developed film is transferred from the processing container through the air to another processing container containing a fixing solution for fixing or the film is immersed in a developing-and-fixing solution contained in a processing container for developing and fixing. When a large number of films are processed at a time or the developing process is performed frequently, the processing solution is contained respectively in processing tanks each having a comparatively large capacity and provided with conveying means, such as conveyor rollers, and films are fed successively to the processing containers for continuous developing. The deteriorated developing solution and the fixing solution (hereinafter referred to inclusively as "processing liquids") deteriorated due to repeated use for developing and fixing are disposed of after being diluted and neutralized according to relevant laws and regulations.

Generally, the processing container or the processing tank for containing the processing liquid is opened to the atmosphere to feed a film into and to take out the same from the container or the tank. Accordingly, the characteristics of the processing liquid deteriorate as the same is used repeatedly and deteriorate naturally with time due to oxidation by air that occurs in the surface of the processing liquid. Furthermore, there is the possibility that the processing liquid wetting the surfaces of the components, such as the conveyor rollers, of the processing apparatus dries and solidifies in particles or crystals, and the particles or crystals damage the film.

Accordingly, when processing a film by a conventional photographic film processing method that passes the film through processing containers or processing tanks containing processing liquids, the characteristics of the processing liquids must be controlled continuously to replenish the processing containers with the processing liquids or to change the processing liquids at the appropriate time, and the components of the processing apparatus in contact with the processing liquids must be frequently cleaned to remove the particles or crystals formed by drying the processing liquids.

However, since such control of the processing solutions and maintenance of the processing apparatus are comparatively troublesome, it often happens that unclear images are formed or images are damaged as a consequence of failure in replenishing the processing tanks, changing the processing liquids or cleaning the components of the processing apparatus at the appropriate time. Since the exhausted processing liquids must be disposed of after dilution and neutralization according to relevant laws and regulations, and the disposal of a large quantity of waste processing liquid requires much time and large cost. Therefore, there has been a demand for a compact photographic film processing apparatus capable of stably processing films by using a comparatively small quantity of a processing liquid and of making cleaning work unnecessary or reducing the frequency of cleaning work.

The inventors had continuously made efforts in improving the conventional photographic film processing apparatus and previously proposed an improved photographic film processing tank in Japanese Patents Nos. 1773397 (Laid Open No. 4-62657) and 1773398 (Laid Open No. 4-62658). This previously proposed photographic film processing tank is provided with a film inlet slit and a film outlet slit which are immersed in water to suppress the deterioration of a processing liquid contained in the photographic film processing tank due to oxidation, and to prevent the solidification and crystallization of the ingredients of the processing liquid due to drying so that the film will not be damaged by the particles or crystals of the ingredients of the processing liquid.

The inventors incorporated further improvements into this previously proposed photographic film processing tank and proposed a photographic film processing apparatus as shown in FIGS. 4(*a*) and 5(*a*) capable of stably processing films by using a very small quantity of a processing liquid and of doing away with troublesome work for supplying and changing a new processing liquid and for cleaning the components in Japanese Patent Application No. Hei 4-1721 (Laid Open No. 5-188559). FIGS. 4(*a*) and 5(*a*) are schematic sectional views of a photographic film processing apparatus in a second embodiment according to the invention applied for in Japanese Patent Application No. Hei 4-1721 and a photographic film processing apparatus in a modification of the former. As shown in FIG. 4(*a*) (FIG. 5(*a*)), the photographic film processing apparatus is provided with processing vessels 42 (52) each having a flat processing chamber 43 (53), a film inlet slit 44 (54) and a film outlet slit 44 (54). The processing vessels 42 (52) are immersed in fresh water W contained in a water tank 41 (51), and a processing liquid is supplied into the flat processing chambers 43 (53) so that the processing liquid will flow alternately in laterally opposite directions to uniformly wet a film F traveling through the processing chambers 43 (53). Thus, this photographic film processing apparatus is capable of stably processing films by using only a very small quantity of the processing liquid, does not require troublesome work for supplying and changing the processing liquid and for cleaning the components, and facilitates the disposal of the exhausted processing liquid.

Since the processing vessel 42 (52) provided with the film inlet slit 44 (54) and the film outlet slit 44 (54) is immersed in the water W, the processing chamber 43 (53) is pressurized so as to balance the pressure of the water W to suppress a leakage of the water W into the processing chamber 43 (53). Although a leakage of the water W into the processing chamber 43 (53) can be suppressed to some extent by this means, the water W leaks unavoidably into the processing chamber 43 (53) or the processing liquid leaks unavoidably into the water W through the film inlet slit 44 (54) and the film outlet slit 44 (54). As shown in FIG. 4(*b*), each of the film inlet slit 44 and the film outlet slit 44 of the photographic film processing apparatus shown in FIG. 4(*a*) is sealed with a pair of soft, elastic sealing lips 45 to prevent the flow of the water W into the processing chamber 43 and the flow of the processing liquid into the water W. As shown in FIG. 5(*b*), a pair of rollers 55 and 55' formed of an elastic material is disposed in contact with each other at each of the film inlet slit 54 and the film outlet slit 54 of the photographic film processing apparatus shown in FIG. 5(*a*), and the gaps between the end wall of the processing chamber 53 and the rollers 55 and 55' are sealed with rubber blades 56. In this photographic film processing apparatus, the rollers 55 and 55' function as means for conveying the film F as well as sealing members.

However, the inventors made further examination of this previously proposed photographic film processing apparatus, and found that there still was room for further improvement in the photographic film processing apparatus.

Although the pairs of flexible sealing lips 45 of the processing vessel shown in FIG. 4(*b*) are formed of a soft, elastic material, there is the possibility that the sensitized layer of the film is rubbed by the flexible sealing lips 45 and scratches are formed in the sensitized layer when the film passes through the space between the pair of flexible lips 45, which is a significant problem particularly when a minute, sharp image must be formed on the film. When the film passes through the processing vessel shown in FIG. 5(*b*), the film is not rubbed and the sensitized layer will not be scratched because the film is advanced by the rotating pairs of rollers 55 and 55'. However, additional power is required to rotate the rollers 55 and 55' against the frictional resistance of the rubber blades 56 in close frictional contact with the rollers 55 and 55'. Particularly, when the photographic film processing apparatus is provided with a plurality of processing vessels as shown in FIG. 5(*b*), the additional power required for rotating the rollers 55 and 55' against the frictional resistance of the rubber blades 56 is considerably large and not ignorable. Furthermore, since the rubber blades 56 are abraded, the processing vessels need frequent maintenance service and inspection.

Although this previously proposed photographic film processing apparatus is capable of stably processing films by using a very small quantity of the processing liquid by making the processing liquid flow alternately in laterally opposite directions in each processing vessel so that the film traveling through the processing vessel is wetted uniformly with the processing liquid, the contact speed of the film, i.e., the speed of the film relative to the processing liquid, is limited because the flow of the processing liquid must inevitably be stopped temporarily when reversing the direction of flow of the processing liquid, which is a restrictive factor on increasing processing speed for quick processing.

SUMMARY OF THE INVENTION

The present invention has been made in view of the foregoing problems in the above-mentioned previously proposed photographic film processing apparatus and it is therefore an object of the present invention to provide a further improved photographic film processing apparatus comprising a water tank containing water, and a processing vessel having a processing chamber containing a processing liquid, provided with two pairs of rollers disposed respectively at its opposite ends so as to seal the processing chamber and immersed in the water contained in the water tank, and capable of passing the film at a high contact speed, i.e., the speed of the film relative to the processing liquid, of operating at a comparatively low power consumption rate, of stably and uniformly processing the film by using a very small quantity of the processing liquid.

A photographic film processing apparatus in a first aspect of the present invention comprises: a water tank for containing water; and at least one processing unit disposed within the water tank and comprising: a pair of feed rollers disposed on a film passage and each having a body formed of an elastic material; a pair of delivery rollers disposed on the film passage at a given distance from the pair of feed rollers and each having a body formed of an elastic material; a pair of sealing rollers disposed one above the other so as to be in contact respectively with both the upper feed roller and the delivery roller, and both the lower feed roller and the delivery roller; and support plates disposed respectively on the opposite sides of the pair of feed rollers, the pair of delivery rollers and the pair of sealing rollers so that a small processing chamber is defined by the circumferences of the pairs of feed rollers, the circumferences of the delivery rollers, the circumferences of the pair of sealing rollers and the inner surfaces of the support plates, supporting the pair of feed rollers, the pair of delivery rollers and the pair of sealing rollers, and provided respectively with a processing liquid inlet port and a processing liquid outlet port.

The photographic film processing apparatus is provided further with a film guide member having a flat fluid passage connected to the processing liquid inlet port and the processing liquid outlet port of the support plates, opening in the shape of a slit opposite to the contact lines of the pair of feed rollers and the pair of delivery rollers, and disposed so as to be spaced apart from the feed rollers, the delivery rollers and the sealing rollers.

A photographic film processing apparatus in a second aspect of the present invention comprises: a water tank for containing water; and a plurality of processing units similar to that of the photographic film processing apparatus in the first aspect of the present invention.

In the photographic film processing apparatus in the second aspect of the present invention, the processing units are disposed in a substantially U-shaped arrangement, and the respective diameters of the top feed roller, the top delivery roller and the top sealing roller are smaller than those of the bottom feed roller, the bottom delivery roller and the bottom sealing roller, respectively.

In the foregoing photographic film processing apparatuses in accordance with the present invention, the processing liquid inlet port and the processing liquid outlet port of the support plates are connected respectively by a supply tube and a return tube to a circulating pump, and the supply tube connected to the processing liquid inlet port or the return tube connected to the processing liquid outlet port is provided with an air vent tank.

The air vent tank may be provided with a cathode plate to recover ionized silver by collecting silver ions by electrodeposition.

In the photographic film processing apparatus in accordance with the present invention, the processing liquid is supplied through the processing liquid inlet port into the processing chamber so that the processing liquid flows across the direction of travel of the film while the film is fed by the feed rollers and delivered by the delivery rollers so as to travel through the processing chamber across the direction of flow of the processing liquid, so that the surface of the film can be uniformly wetted with the processing liquid and the desired reaction between the processing liquid and the sensitized layer coating of the film occurs satisfactorily.

Since the respective bodies of the pair of feed rollers and the pair of delivery rollers are formed of an elastic material, the pair of sealing rollers are in close contact with the pair of feed rollers and the pair of delivery rollers, and the opposite ends of the bodies of the pair of feed rollers and the pair of delivery rollers are in direct, close contact with or in indirect contact through sealing rings with the inner surfaces of the support plates, the processing chamber can be sealed in a liquid-tight fashion. Since the film is held between the pair of rotating feed rollers and between the pair of rotating delivery rollers, the film can positively be conveyed through the processing chamber without being scratched and without adversely affecting the sealing effect of the pair of feed rollers and the pair of delivery rollers.

Since only the opposite ends of the bodies of the pair of feed rollers and the pair of delivery rollers are in sliding contact with the adjacent components, frictional resistance against the rotation of the pair of feed rollers and the pair of delivery rollers is comparatively small and, consequently, the pair of feed rollers and the pair of delivery rollers can be driven for rotation by a comparatively small power.

Since the processing chamber of the processing unit can be formed in a small sectional area and a small capacity only to enable the film to travel therethrough and to enable the processing liquid to flow across the direction of travel of the film, the processing chamber can be filled up with a small quantity of the processing liquid and the processing liquid can flow across the direction of travel of the film at a comparatively high velocity, so that the contact speed of the film is comparatively high and the film can stably and quickly be processed by using a comparatively small quantity of the processing liquid.

Since the processing unit is immersed in water contained in the water tank, a leakage of the processing liquid from the processing chamber of the processing unit into the water tank can be suppressed by balancing the pressure of the water contained in the water tank and that of the processing liquid in the processing chamber and the processing liquid supplied into the processing chamber can perfectly be isolated from the atmosphere, the deterioration of the properties of the processing liquid due to oxidation and the solidification and/or crystallization of the processing liquid that will damage the film can be prevented. The developed film can continuously be washed by the water contained in the water tank.

Since the processing liquid wetting the film and the circumferences of the feed rollers, the delivery rollers and the sealing rollers and brought outside the processing chamber as the feed rollers, the delivery rollers and the sealing rollers rotate and as the film travels through the water disperses in the water contained in the water tank and is diluted by the water, the processing liquid dispersed in the water contained in the water tank can be discharged properly by controlling the rate of supply of water into the water tank and the water containing the processing liquid, discharged from the water tank can be neutralized simply by adding a neutralizing agent to the discharged water so as to meet the relevant laws and regulations and the neutralized waste water can directly be disposed of.

Since the film guide member having a flat fluid passage connected to the processing liquid inlet port and the processing liquid outlet port of the support plates, opening in the shape of a slit opposite to the contact lines of the pair of feed rollers and the pair of delivery rollers, and disposed so as to be spaced apart from the feed rollers, the delivery rollers and the sealing rollers are disposed within the processing chamber, a processing liquid passage and a film passage respectively having desired shapes can be formed in the processing chamber so that the processing liquid will flow properly at a high velocity along the surface of the film and the film will stably travel through the processing chamber and, consequently, the film can uniformly and surely be wetted with the processing liquid, the contact speed can be increased and the film can stably and quickly be processed by using a comparatively small quantity of the processing liquid.

The photographic film processing apparatus provided with the plurality of processing units arranged one after another on the film path and having common support plates is capable of successively carrying out, for example, a developing process, a fixing process and a washing process by supplying different processing liquids respectively to the plurality of processing units. Since all the plurality of processing units are immersed in water, the film can be washed while the same travels from the processing unit to the next processing unit, so that the adverse influence of the processing liquid used in the preceding processing unit on that used in the succeeding processing unit can be avoided to enable the succeeding processing unit to achieve its function satisfactorily. Since the components of the plurality of processing units are supported on the common support plates, the photographic film processing apparatus has a simple, compact construction.

In the photographic film processing apparatus provided with the plurality of processing units disposed in a substantially U-shaped arrangement, a long film can be fed downward into the first processing unit and can be delivered upward from the last processing unit, which facilitates the handling of the long film, enables the photographic film processing apparatus to be formed in a comparatively small longitudinal size and in a compact construction. When the respective diameters of the top feed roller, the top delivery roller and the top sealing roller are smaller than those of the bottom feed roller, the bottom delivery roller and the bottom sealing roller, respectively, the film is able to approach the contact line between the top and bottom feed rollers obliquely downward and to leave the contact line between the top and bottom delivery rollers obliquely upward when the processing units are disposed in a substantially U-shaped arrangement, which facilitates the feed and delivery of the film.

Since the processing liquid inlet port and the processing liquid outlet port are connected individually by a supply tube and a return tube to the circulating pump so as to form a closed circuit consisting of the processing unit, the supply tube, the return tube and the circulating pump, a fixed small quantity of the processing liquid can be circulated through the processing chamber across the direction of travel of the film for a plurality of processing cycles. The air vent tank connected to the supply tube or the return tube connected, respectively, to the processing liquid supply port or the outlet port of the processing unit enables the extraction of air unavoidably mixed in the processing liquid when replenishing the closed circuit with the processing liquid to prevent the reduction of the accuracy of the process due to bubbles contained in the processing liquid.

The cathode plate disposed within the air vent tank connected to the supply tube or the return tube connected to the processing liquid supply port and outlet port of the processing unit serving as a fixing unit to collect silver ions by electrodeposition enables the recovery of ionized silver.

The processing liquid is any one of solutions generally used for processing a photographic film, such as a developing solution, a fixing solution, a developing-and-fixing solution, a coupler solution and a finishing solution, or clean water for washing.

BRIEF DESCRIPTION OF THE DRAWINGS

The above and other objects, features and advantages of the present invention will become more apparent from the following description taken in connection with the accompanying drawings, in which:

FIG. 1(*b*) is a sectional view taken on line A—A in FIG. 1(*a*);

FIG. 3(*b*) is a diagrammatic side view of a driving system included in the photographic film processing apparatus of FIG. 3(*a*);

FIG. 4(*b*) is a sectional view of a processing unit included in the photographic film processing apparatus of FIG. 4(*a*);

FIG. 5(*b*) is a sectional view of a processing unit included in the photographic film processing apparatus of FIG. 5(*a*).

DETAILED DESCRIPTION OF THE PREFERRED EMBODIMENTS

Figure 1A:
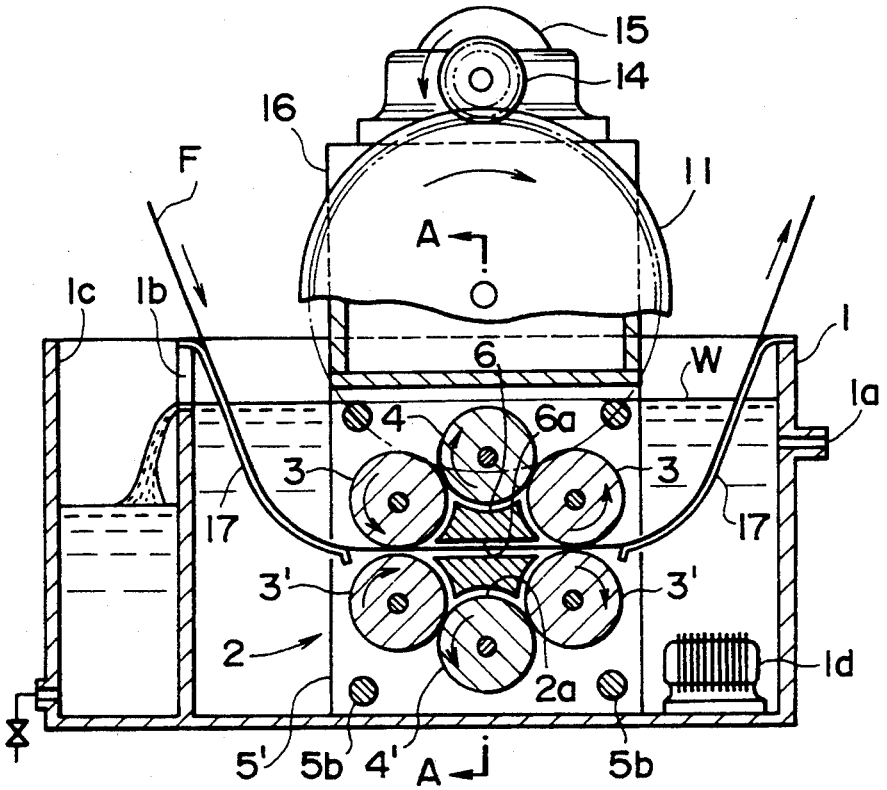
FIG. 1(*a*) is a partly cutaway front view of a photographic film processing apparatus in a first embodiment according to the present invention.
Figure 1B:
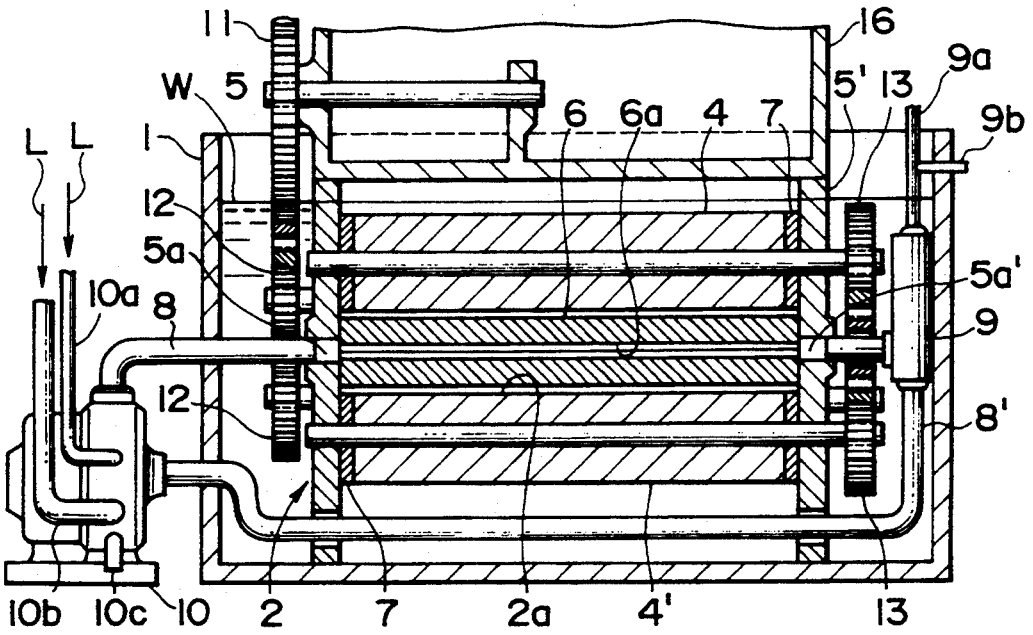

Referring to FIGS. 1(*a*) and 1(*b*) showing a photographic film processing apparatus in a first embodiment according to the present invention, the interior of a water tank 1, which is a rectangular parallelepipedic tank opening upward, is divided into a drain chamber 1*c* and a water chamber with a partition wall provided with an overflow hole 1*b* for limiting the level of water in the water chamber of the water tank 1. A water supply port 1a formed in one end wall of the water tank 1 is connected to a water supply means, not shown. A heater 1*d* for regulating the temperature of the water contained in the water tank 1 is placed on the bottom wall of the water tank 1.

A processing unit 2 comprises a pair of feed rollers 3 and 3' for feeding a film F, a pair of delivery rollers 3 and 3' for delivering the film F, a top sealing roller 4 disposed in contact with both the top feed roller 3 and the top delivery roller 3, a lower sealing roller 4' disposed in contact with both the bottom feed roller 3' and the bottom delivery roller 3', and pair of rectangular support plates 5 and 5' rotatably supporting the feed rollers 3 and 3', the delivery rollers 3 and 3' and the sealing rollers 4 and 4' at their opposite ends, respectively. Thus, a processing chamber 2*a* having a small capacity is defined by the circumferences of the feed rollers 3 and 3', the delivery rollers 3 and 3' and the sealing rollers 4 and 4', and the inner surfaces of the support plates 5 and 5'. As shown in FIG. 1(*b*), the support plates 5 and 5' are provided respectively with a processing liquid inlet port 5*a* and a processing liquid outlet port 5*a'*. Each of the feed rollers 3 and 3', the delivery rollers 3 and 3' and the sealing rollers 4 and 4' is a flat rubber roller formed by bonding a rubber body to a metallic shaft.

A film guide member 6 is held at its opposite ends on the support plates 5 and 5' so as to be spaced apart from the feed rollers 3 and 3', the delivery rollers 3 and 3' and the sealing rollers 4 and 4'. The film guide member 6 has a flat liquid passage 6a having an inlet end and an outlet end having the shape of a slit, and connected to the processing liquid inlet port 5*a* of the support plate 5 and the processing liquid outlet port 5*a'* of the support plate 5'. The film guide member 6 is formed of a polyvinyl chloride resin by extrusion molding and has laterally elongate circular recesses conforming respectively to the circumferences of the feed rollers 3 and 3', the delivery rollers 3 and 3' and the sealing rollers 4 and 4'.

The opposite ends of the shafts of the feed rollers 3 and 3', the delivery rollers 3 and 3' and the sealing rollers 4 and 4' are journaled on and project outside from the support plates 5 and 5', respectively Flat sealing rings 7 each formed by attaching a Teflon sheet having a low frictional property to a silicone rubber plate are interposed between the opposite ends of the rubber bodies of the feed rollers 3 and 3', the delivery rollers 3 and 3' and the sealing rollers 4 and 4', and the inner surfaces of the support plates 5 and 5', respectively, to seal gaps between the opposite ends of the rubber bodies and the support plates 5 and 5' so that only low frictional resistance will act against the rotation of the rollers 3, 3', 4 and 4'. The support plates 5 and 5' thus supporting the feed rollers 3 and 3', the delivery rollers 3 and 3', the sealing rollers 4 and 4' and the film guide 6 are fastened at their four corners to the opposite ends of stay rods 5*b* in parallel to each other to form the processing unit 2.

The processing unit 2 is immersed completely in clean water W contained in the water tank 1 so that the circumference of the top sealing roller 4 is located slightly beneath the regulated surface of the water W. The processing liquid supply port 5*a* and the processing liquid outlet port 5*a'* are connected respectively by a supply tube 8 and a return tube 8' to a centrifugal circulating pump 10 to form a closed circuit consisting of the processing chamber 2*a*, the tubes 8 and 8' and the circulating pump 10. A replenishing pipe 10*a* for trickling a processing liquid L into the closed circuit for replenishment, a supply pipe 10*b* for the initial supply of the processing liquid L to fill up the closed circuit with the processing liquid L before starting the processing operation, and a drain pipe 10*c* for draining the closed circuit to change the processing liquid L are connected to the circulating pump 10. A small air vent tank 9 is provided on the return tube 8', an air vent pipe 9*a* projects upward from the air vent tank 9, and an overflow pipe 9*b* is branched from the air vent pipe 9a at a position above the surface of the water W. The overflow pipe 9b is connected by a transparent pipe to the drain chamber 1c of the water tank 1.

A driving gear 11 is supported for rotation on a frame 16 supported on the support plates 5 and 5' of the processing unit 2, and a pinion 14 attached to the output shaft of a geared motor 15 mounted on the frame 16 and the driving gear 11 are engaged.

Figure 2A:
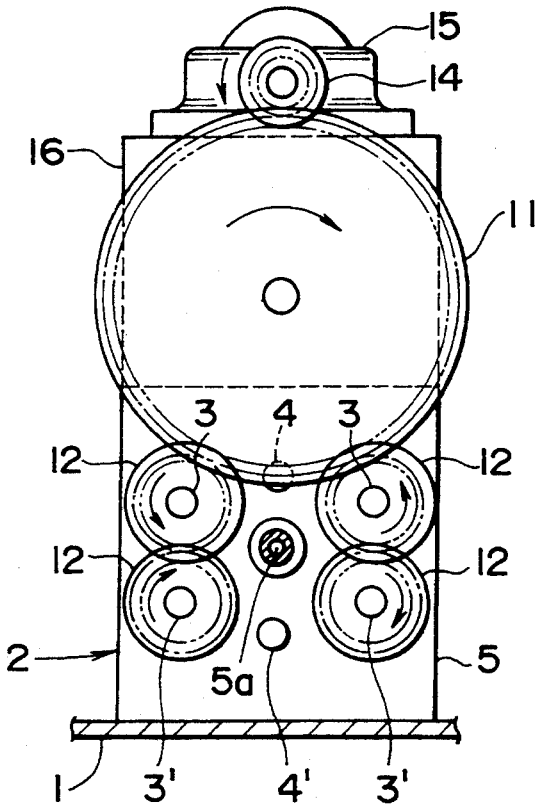
FIGS. 2(*a*) and 2(*b*) are side views of a driving system included in the photographic film processing apparatus of FIG. 1(*a*)
Figure 2B:
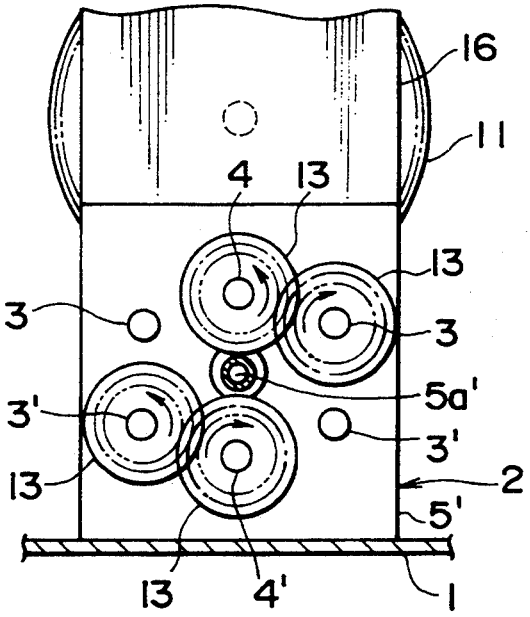

A driving system for driving the rollers 3, 3', 4 and 4' will be described hereinafter with reference to FIGS. 2(*a*) and 2(*b*). As shown in FIG. 2(*a*), gears 12 are attached to the ends of the shafts of the feed rollers 3 and 3' and the delivery rollers 3 and 3' projecting outside from the support plate 5 of the processing unit 2, and the gears 12 attached to the shafts of the top feed roller 3 and the top delivery roller 3 are in engagement with the gear 11. As shown in FIG. 2(*b*), gears 13 are attached to the ends of the shafts of the bottom feed roller 3', the top delivery roller 3 and the sealing rollers 4 and 4' projecting outside from the other support plate 5' so that the gears attached to the shafts of the bottom feed roller 3' and the top delivery roller 3 are in engagement respectively with the gears 13 attached to the shafts of the bottom sealing roller 4' and the top sealing roller 4. Thus, the feed rollers 3 and 3', the delivery rollers 3 and 3' and the sealing rollers 4 and 4' are driven for synchronous rotation by the geared motor 15. In this photographic film processing apparatus, the driving system drives the rollers 3, 3', 4 and 4' of the processing unit 2 for synchronous rotation in the directions of the arrows as shown in FIG. 1(*a*) to pass the film F through the processing chamber 2a. The liquid-tight sealing of the processing chamber 2a is maintained while the film F travels through the processing chamber 2a.

Film guides 17 are extended in spaces in the water tank 1 on the inlet side and the outlet side of the processing unit 2, respectively, so as to guide the film F toward the contact line between the feed rollers 3 and 3' and to guide the film F delivered by the delivery rollers 3 and 3'. Each film guide 17 is formed by laterally arranging a plurality of Teflon-coated stainless steel wires. The film F travels toward the processing unit 2 along the film guide 17 and travels away from the processing unit 2 along the other film guide 17.

When processing the film F by the photographic film processing apparatus, fresh water W is supplied continuously into the water tank 1 so that the processing unit 2 is immersed in the fresh water W contained in the water tank 1, and the processing liquid L is supplied through the supply pipe 10b connected to the circulating pump 10 to fill up the closed circuit connected to the processing chamber 2a of the processing unit 2 with the processing liquid L. Then, the geared motor 14 is started to rotate the rollers 3, 3', 4 and 4' of the processing unit 2 and the circulating pump 10 is started to circulate the processing liquid L through the closed circuit so that the processing liquid L flows at a high velocity through the processing chamber 2a. The processing liquid L is trickled through the replenishing pipe 10a connected to the circulating pump 10 while confirming the discharge of air through the air vent tank 9. After the closed circuit has completely been deaerated, the film F is fed along the film guide 17 into the processing unit 2. The film F travels through the fresh water W to the feed rollers 3 and 3', the film F is passed through the processing chamber 2a and is delivered into the fresh water W by the rollers 3 and 3'. The developed film F is washed while traveling through the fresh water W.

Since the processing liquid L flows at a high velocity from one side of the processing chamber 2a across the film F toward the other side of the processing chamber 2a, the surface of the film F is wetted uniformly with the processing liquid L in the processing chamber 2a to cause desired reaction between the processing liquid L and the sensitized layer of the film F.

The film guide member 6 disposed within the processing chamber 2a of the processing unit 2 defines a processing liquid passage and a film passage in a desired shape within the processing chamber 2a and reduces the effective capacity of the processing chamber 2a. Consequently, the processing liquid L flows in rectified streams along the surface of the film F at an increased velocity, the processing liquid L wets uniformly the surface of the film F traveling through the processing chamber 2a and enhances the contact speed. Formation of bubbles in the processing liquid L circulating at a high velocity through the closed circuit including the processing chamber 2a can be prevented by discharging air unavoidably let into the closed circuit when replenishing the closed circuit with the processing liquid L. Thus, the film F can stably and quickly be processed by using a very small quantity of the processing liquid L.

Since the circumferences of the rubber bodies of the contiguous rollers 3, 3', 4 and 4' defining the processing chamber 2a of the processing unit 2 are in close contact with each other while the rollers 3, 3', 4 and 4' are rotated and the gaps between the opposite ends of the rubber bodies of the rollers 3, 3', 4 and 4' and the inner surfaces of the support plates 5 and 5' are sealed with the sealing rings 7, the processing chamber 2a is sealed in a liquid-tight fashion all the time. Since only the opposite ends of the rubber bodies are in sliding contact with the sealing rings 7 having a low frictional property, frictional resistance against the rotation of the rollers is comparatively small and hence the photographic film processing apparatus requires comparatively small power for operation.

Since the processing unit 2 is immersed in the fresh water W contained in the water tank 1, the pressure of the fresh water W suppresses a leakage of the processing liquid L from the chamber 2a and isolates the processing liquid L in the processing chamber 2a perfectly from the atmosphere to prevent the deterioration of the processing liquid L due to oxidation and to prevent damaging the film F by particles and crystals of the ingredients of the processing liquid L formed on the rollers of the processing unit 2 due to drying.

A very small quantity of the processing liquid L unavoidably taken out from the processing chamber 2a by the traveling film F and the rotating rollers 3, 3', 4 and 4' disperses in and is diluted by the fresh water W contained in the water tank 1 and the dilute processing liquid spills from the water chamber into the drain chamber 1c. Fresh water is supplied at an appropriate supply rate into the water tank 1, the dilute processing liquid contained in the drain chamber 1c can be treated only with a neutralizing agent into waste water meeting the relevant laws and regulations. The water temperature regulating heater 1d placed within the water tank 1 regulates the respective temperatures of the fresh water W contained in the water tank 1 and the processing liquid L flowing through the processing chamber 2a of the processing unit 2 to further stabilize the processing operation.

The photographic film processing apparatus and the photographic film processing operation of the same will more concretely be described hereinafter.

The processing chamber 2a of the processing unit 2 has an inside width, i.e., a dimension across the direction of travel of the film F, of 80 mm, an inside length, i.e., a dimension along the direction of travel of the film F, of 20 mm and an effective capacity of about 5 $cm^3$, the flat liquid passage 6a of the film guide member 6 has a thickness of about 3 mm, the supply tube 8 and the return tube 8' connecting the processing chamber 2a of the processing unit 2 to the circulating pump 10 are rubber tubes having an inside diameter of 6 mm, the capacity of the closed circuit is about 25 $cm^3$ the water tank 1 is about 150 mm in width, about 150 mm in length and about 100 mm in height, and the temperature of the fresh water W contained in the water tank 1 is regulated at about 33° C.

The relation between the duration of contact between the processing liquid and the film, and the velocity of the processing liquid was examined through the experimental operation of the photographic film processing apparatus to determine optimum processing conditions. The processing liquids were a developing solution capable of developing the film in a given photographic density when the film is immersed in a stationary manner therein for 20 sec or longer and a fixing solution capable of perfectly fixing the film when the film is immersed in a stationary manner therein for 20 sec or longer, film speed was varied to keep the film in contact with the processing liquid for contact times, i.e., the duration of contact between the film and the processing liquid, of 5 sec, 10 sec, 15 sec and 23 sec.

The closed circuit including the processing chamber 2a was filled up with about 25 $cm^3$ of the processing liquid and the closed circuit was deaerated. Exposed films of 40 mm in width and 30 mm in length were passed through the processing chamber 2a at different traveling speeds so that the foregoing four contact times were obtained in three processing modes, i.e., a stationary mode in which the processing liquid is not circulated, a low-speed mode in which the processing liquid flows through the processing chamber 2a at a velocity of 250 mm/sec and a high-speed mode in which the processing liquid flows through the processing chamber 2a at a velocity of 500 mm/sec for each of developing experiments and fixing experiments, and the photographic densities and the degrees of fixation of the processed films were examined for comparative evaluation.

The results of comparative evaluation are tabulated in Table 1 showing the measured photographic densities for contact time and processing mode, and Table 2 showing the degrees of fixation. Photographic densities of 2.1 or above are acceptable.

TABLE 1

| Velocity of the processing liquid (mm/sec) | Contact time (sec) | | | |
|---|---|---|---|---|
| | 5 | 10 | 15 | 23 |
| 0 | 0.63 | 0.83 | 1.35 | *2.24 |
| 250 | 0.95 | 1.57 | 2.04 | *2.25 |
| 500 | 1.14 | *2.12 | *2.20 | *2.28 |

In Table 1, acceptable photographic densities are asterisked.

TABLE 2

| Velocity of the processing liquid (mm/sec) | Contact time (sec) | | | |
|---|---|---|---|---|
| | 5 | 10 | 15 | 23 |
| 0 | — | — | — | 0 |
| 250 | — | 0 | 0 | 0 |
| 500 | 0 | 0 | 0 | 0 |

As is obvious from Tables 1 and 2, while it takes 20 sec or longer for satisfactory developing and fixing when the films are processed for developing and fixing in the stationary mode, it takes half the time necessary for satisfactorily developing and fixing the films in the stationary mode or less when appropriate combinations of the velocity of the processing liquid and the film speed are determined selectively. To confirm the performance of the photographic film processing apparatus, 1000 exposed films were subjected to developing experiment and fixing experiment, in which the closed circuit was filled up with 25 $cm^3$ of the processing liquid before starting the photographic film processing apparatus, the velocity of the processing liquid in the processing chamber 2 as 500 mm/sec, the traveling speed of the film was 2 mm/sec (contact time of 10 sec) and the closed circuit was replenished with the processing liquid at a rate of 0.3 $cm^3$ per film. The experiment was carried out continuously or for two successive days.

All the exposed films were developed and fixed satisfactorily and it seemed possible to process more than 1000 exposed films in that manner. However, in the developing experiment, reduced silver deposited on the circumferences of the feed rollers and the delivery rollers of the processing unit and the deposition of reduced silver increased with the time. Therefore, it was found that the feed rollers and the delivery rollers must be cleaned after developing about 800 exposed films or the feed rollers and the delivery rollers must continuously be cleaned during operation with felt strips or the like disposed in contact with the circumferences of the rubber bodies of the feed rollers and the delivery rollers.

In another developing and fixing experiment, the closed circuit was filled up with 25 $cm^3$ of a developing-and-fixing solution capable of both developing and fixing an exposed film in 20 sec or longer in the stationary mode while the closed circuit was deaerated, the developing-and-fixing solution was circulated through the processing chamber at a high velocity of 500 mm/sec and an exposed dental X-ray film of 40 mm in width and 30 mm in length was passed through the processing chamber at a travelling speed of 1.3 mm/sec. A sharp image of uniform photographic density was developed. Then, exposed dental X-ray films were subjected successively to developing and fixing under the same developing and fixing conditions and the closed circuit was replenished with the developing-and-fixing solution at a rate of 0.3 $cm^3$ per film. About 200 exposed dental X-ray films could satisfactorily be developed and fixed.

As is apparent from the foregoing description, the photographic film processing apparatus in the first embodiment is capable of quickly and stably developing an exposed film in a uniform photographic density by using a very small quantity of the processing liquid which may be used for only one developing cycle, and has a compact construction, for example, a construction of about 250 mm in overall height, about 150 mm in width and about 150 mm in length.

Although the feed rollers, the delivery rollers and the sealing rollers of the photographic film processing apparatus in the first embodiment have the rubber bodies, the liquid-tight processing chamber can be formed even if the bodies of the sealing rollers are formed of a hard material, such as a metal, provided that the feed rollers and the delivery rollers have elastic materials bodies. When the processing chamber has a very small capacity, the film guide member may be omitted.

Although the air vent tank which enables the extraction of air from the closed circuit is connected to the return tube connected to the processing liquid outlet port in the first embodiment, the air vent tank may be connected to the supply tube connected to the supply port. In this case, processing liquid pressure in the processing chamber can be controlled in low pressure by regulating the fluid resistance of the return side processing liquid circuit lower than the supply side processing liquid circuit.

Although the photographic film processing apparatus in the first embodiment supplies the processing liquid continuously in a fixed direction so that the processing liquid will flow in a fixed direction across the direction of travel of the film, the processing liquid may be supplied so as to flow alternately in opposite directions by alternately operating connecting displacement pumps or the like connected respectively to the processing liquid inlet port and the processing liquid outlet port. The latter method of supplying the processing liquid needs a comparatively short closed circuit and hence a smaller quantity of the processing liquid.

The photographic film processing apparatus in the first embodiment is provided with a single processing unit disposed within the water tank, and uses a developing-and-fixing solution as the processing liquid for both developing and fixing. A photographic film processing apparatus in a modification may be provided with a plurality of processing units similar to that of the photographic film processing apparatus in the first embodiment sequentially arranged along a film path, and a plurality of processing liquids, such as a developing solution, a fixing solution and fresh water, may be circulated respectively through the plurality of processing units for a continuous developing, fixing and washing operation. In this modification, the film is washed when traveling from the preceding processing unit to the succeeding processing unit with the fresh water contained in the water tank, so that the adverse effect of the processing liquid circulated through the preceding processing unit on the processing liquid circulated through the succeeding processing unit can be avoided and the film can stably be processed. In this modification, the rollers of the plurality of processing units are supported on common support plates to form the photographic film processing apparatus in a compact construction.

A photographic film processing apparatus in a second embodiment according to the present invention will be described hereinafter with reference to FIGS. 3(*a*) and 3(*b*), in which parts like or corresponding to those of the photographic film processing apparatus in the first embodiment are denoted by the same reference characters and the description thereof will be omitted.

Basically, the photographic film processing apparatus in the second embodiment is similar to that in the first embodiment, except that the former has a plurality of processing units, which are similar to that of the former, supported on a pair of common support plates in a substantially U-shaped arrangement.

Figure 3A:
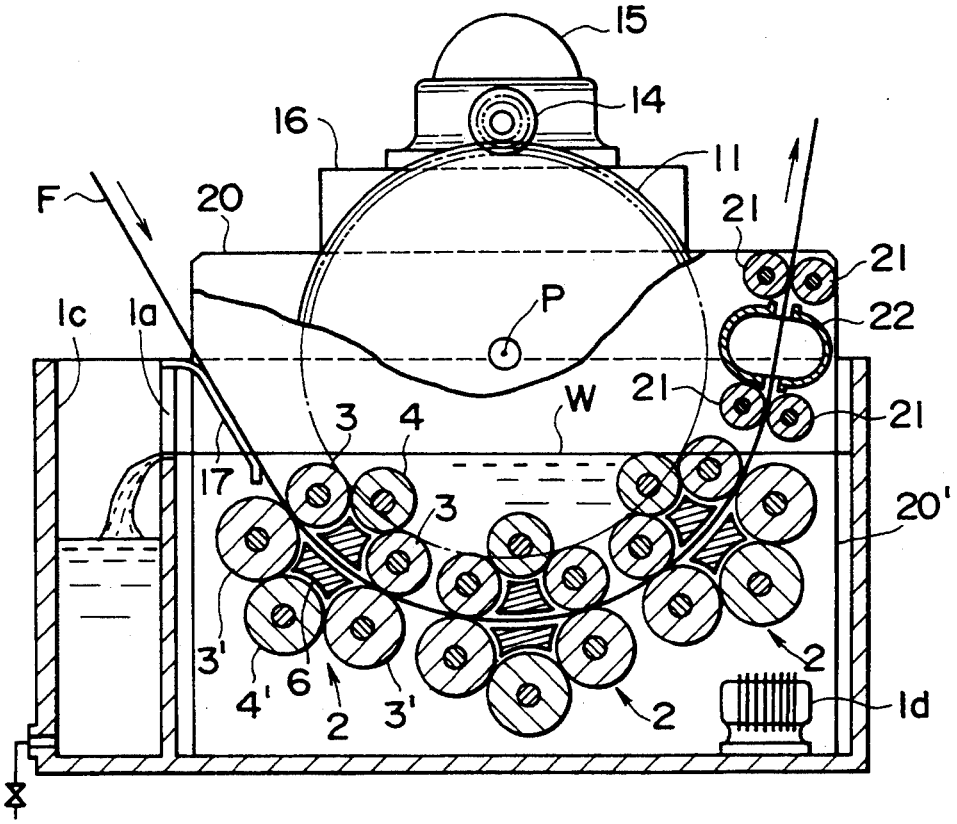
FIG. 3(*a*) is a partly cutaway front view of a photographic film processing apparatus in a second embodiment according to the present invention.
Figure 3B:
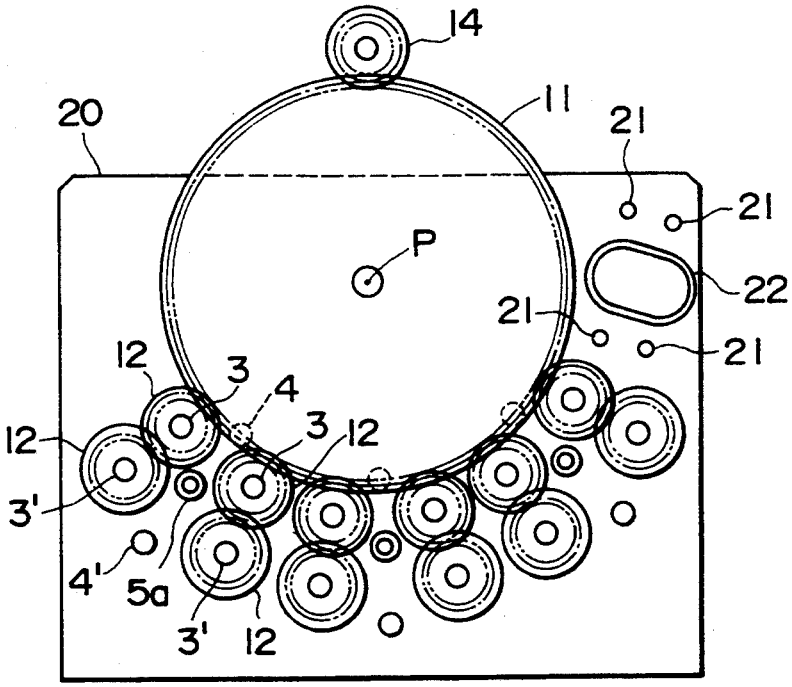
Figure 4A:
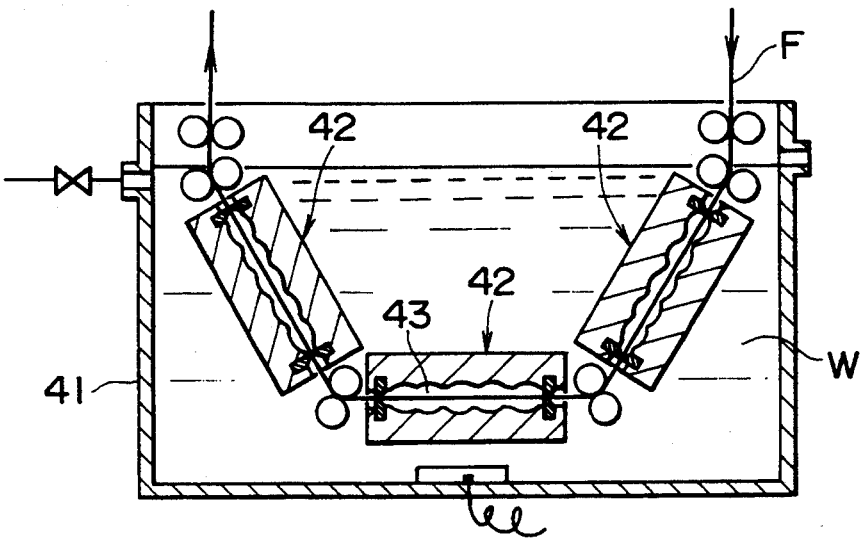
FIG. 4(a) (PRIOR ART)
FIG. 4(*a*) is a schematic sectional view of a photographic film processing apparatus disclosed in a patent application previously made by the applicant of the present patent application.
Figure 4B:
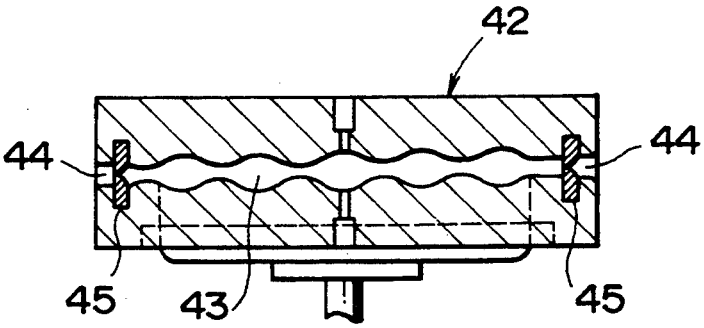
FIG. 4(b) (PRIOR ART)
Figure 5A:
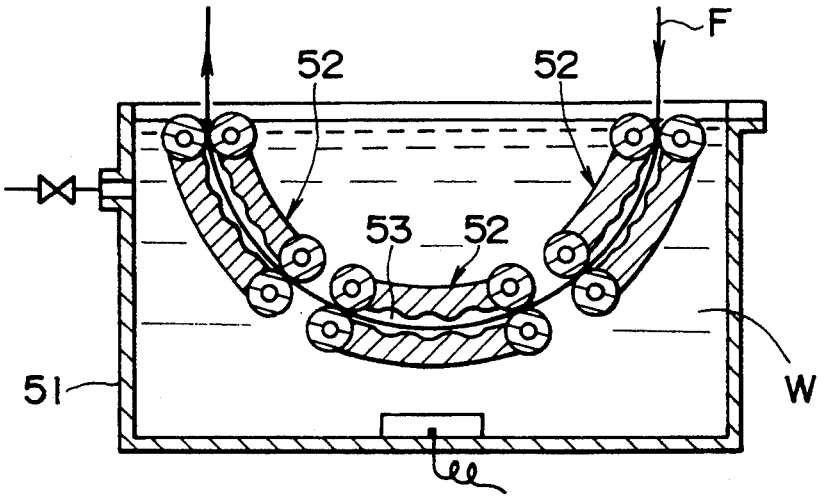
FIG. 5(a) (PRIOR ART)
FIG. 5(*a*) is a schematic sectional view of a photographic film processing apparatus disclosed in the patent application previously made by the applicant of the present patent application.
Figure 5B:
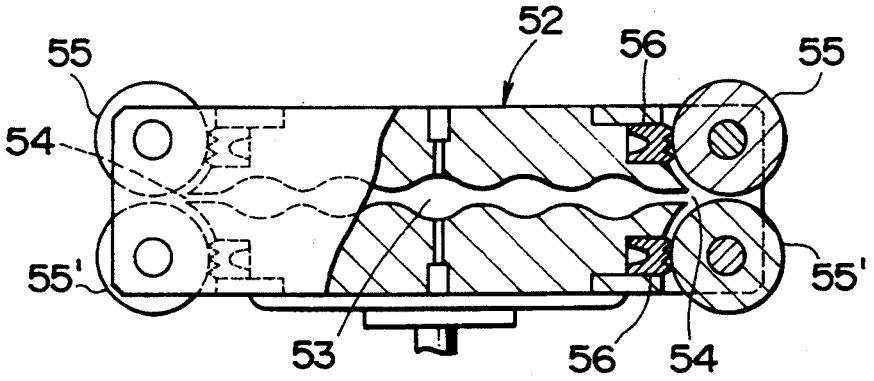
FIG. 5(b) (PRIOR ART)

Referring to FIG. 3(*a*), the photographic film processing apparatus has three processing units 2 formed on a pair of common support plates 20 and 20' in a sequential, U-shaped arrangement on an upwardly opening arc of a circle having its center at a point P. Each of the processing units 2 comprises a pair of feed rollers 3 and 3', a pair of delivery rollers 3 and 3', a pair of sealing rollers 4 and 4', and the pair of common support plates 20 and 20'. The rollers 3, 3', 4 and 4' are arranged so as to define a processing chamber **2*a*** having a small capacity.

The diameters of the top feed roller 3, the top delivery roller 3 and the top sealing roller 4 are smaller than those of the bottom feed roller 3', the bottom delivery roller 3' and the bottom sealing roller 4' to enable a film F to approach the contact line between the feed rollers 3 and 3' of the processing unit 2 obliquely downward and to leave the contact line between the delivery rollers 3 and 3' of the same processing unit 2 obliquely upward, and to facilitate the circular arrangement of the processing units 2 and the travel of the film F through the processing units 2.

Two pairs of guide rollers 21 are disposed, instead of the film guide 17, below the last processing unit 2 with respect to the direction of travel of the film F, and the two pairs of guide rollers 21 are supported for rotation on the pair of support plates 20 and 20'. A duct 22 having an inlet slit and an outlet slit is disposed between the two pairs of guide rollers 21 and is extended across and through the pair of support plates 20 and 20'. The two pairs of guide rollers 21 and the duct 22 are disposed so that the film F is able to travel without touching any part of the duct 22. One end of the duct 20 is connected to a hot air supply device, not shown.

A driving gear 11 is supported for rotation on the pair of common support plates 20 and 20' supporting the processing units 2, with its center on the point P. A geared motor 15 is mounted on a frame 16 supported on the pair of common support plates 20 and 20'. As shown in FIG. 3(*b*), a pinion 14 attached to the output shaft of the geared motor 15 and the driving gear 11 are engaged, the driving gear 11 and a gear 12 attached to one end of the shaft of each of the top feed rollers 3 and the top delivery rollers 3 of the processing units 2 are engaged to rotate the feed rollers 3 and 3' and the delivery rollers 3 and 3' of the three processing units 2 synchronously. Similarly to the arrangement shown in FIG. 2(*b*), gears 13, not shown, attached to the other end of one of the feed rollers 3 and 3', the other end of one of the delivery rollers 3 and 3', and the corresponding ends of the sealing rollers 4 and 4' of each processing unit 2 are engaged to rotate all the rollers 3, 3', 4 and 4' of all the processing units 2 synchronously by the geared motor 15.

Although not shown in FIGS. 3(*a*) and 3(*b*), in this photographic film processing apparatus, the processing chamber **2*a* of each of the first processing unit 2 and the second processing unit 2 subsequent to the first processing unit 2, similarly to the processing chamber 2*a* of the processing unit 2 of the photographic film processing apparatus in the first embodiment, is included in a closed circuit comprising a supply tube 8, a return tube 8' and a circulating pump 10, and a small air vent tank 9 is provided on the return tube 8' connected to the outlet port of the processing chamber 2*a*. A sealed trickling bag containing a predetermined quantity of a processing liquid is connected to the trickling pipe 10*a* connected to the circulating pump 10**.

Felt strips are placed in sliding contact with the circumferences of the bodies of the feed and the delivery rollers 3 and 3' of the first processing unit 2 to remove reduced silver deposited on the circumferences of the bodies of the feed and the delivery rollers 3 and 3' during the photographic film processing operation.

A cathode plate for collecting silver ions ejected from the film F to recover ionized silver is placed within the air vent tank 9 placed on the return tube 8' connected to the outlet port of the processing chamber 2a of the second processing unit 2.

The supply tube 8 connected to the inlet port of the processing chamber 2a of the third processing unit 2, i.e., the last processing unit 2, is connected to a fresh water supply device for supplying fresh water W into the processing chamber 2a, and the return tube 8' connected to the outlet port of the same processing chamber 2a is opened into the water tank 1. Thus, the processing chamber 2a of the third processing unit 2 is included in an open circuit, and the fresh water W supplied into the processing chamber 2a is discharged into the water tank 1 to supply fresh water W continuously into the water tank 1.

In this photographic film processing apparatus, the first and the second processing unit 2 are immersed completely in the fresh water W contained in the water tank 1, while the upper part of the third processing unit 2 is partially exposed on the surface of the fresh water W, and the duct 22 is extended over the surface of the fresh water W in the water tank 1. A developing solution, a fixing solution and fresh water W are circulated respectively through the first, the second and the third processing unit 2, and hot air is caused to flow through the duct 22. The film F travels toward the first processing unit along the film guide 17 and sequentially through the processing chambers 2a of the first, the second and the third processing unit 2 and the duct 22 for successive developing, fixing, washing and drying.

The photographic film processing apparatus and the photographic film processing operation of the same will more concretely be described hereinafter.

The processing chamber 2a of each of the processing units 2 has an inside width of 160 mm, an inside length, i.e., a dimension along the direction of travel of the film F, of 20 mm and an effective capacity of about 10 $cm^3$, the flat liquid passage 6a of the film guide member 6 has a thickness of about 3 mm, the supply tubes 8 and the return tubes 8' connecting the processing chambers 2a of the processing units 2 to the corresponding circulating pumps 10 are, similarly to those of the first embodiment, rubber tubes having an inside diameter of 6 mm, the capacity of each of the closed circuits is about 30 $cm^3$, and the water tank 1 is about 230 mm in width, about 200 mm in height and about 150 mm in height, and the temperature of the fresh water W contained in the water tank 1 is regulated at about 33° C.

After filling up the closed circuits respectively including the processing chambers of the first and the second processing unit with a developing solution (about 30 $cm^3$) capable of developing the film F in a given photographic density in 20 sec or longer in the stationary mode and a fixing solution (about 30 $cm^3$) capable of completely fixing the film in 20 sec or longer in the stationary mode, respectively, and deaerating the same closed circuits, the developing solution and the fixing solution were circulated so as to flow through the processing chambers at a high velocity of 500 mm/sec. Fresh water was supplied into the processing chamber of the third processing unit so as to flow through the processing chamber at a high velocity. An exposed dental panoramic X-ray film of 150 mm in width and 300 mm in length was passed through the first, the second and the third processing unit at a traveling speed of 2 mm/sec (contact time: 10 sec) for photographic processing. When a plurality of exposed films were processed successively, the closed circuits were replenished by trickling with the developing solution and the fixing solution, respectively, at a rate of 10 $cm^3$ per film.

Thus, the X-ray film could thoroughly be processed for the photographic film processing steps from fixing to drying at a one-point passage time (top-to-top time) of 55 sec corresponding to a high cycle time of 3 min and 25 sec, and a sharp image having uniform photographic density could be formed. Exposed dental X-ray films of 40 mm in width and 30 mm in length were subjected successively to photographic film processing, in which the closed circuits were replenished by trickling with the developing solution and the fixing solution, respectively, at a rate of 0.5 $cm^3$ per film. Each X-ray film could be processed thoroughly in a short time of 65 sec, and images having uniform photographic density could stably be formed.

Incidentally, according to catalog data, most compact photographic film processing apparatuses currently available on the market require a one-point passage time (top-to-top time) in the range of 3 to 6 min, and a quantity of the processing liquid more than three times that of the same required by the photographic film processing apparatus in the second embodiment for processing a film.

As is apparent from the foregoing description, the photographic film processing apparatus in the second embodiment is capable of processing films stably at a high processing speed by using a very small quantity of the processing liquid, of easily handling a comparatively long film by conveying the comparatively long film along a substantially U-shaped film path, namely, by receiving the long film from above and delivering the same upward, and of stably processing a comparatively short film by conveying the comparatively short film with the feed and the delivery rollers of each processing unit. Furthermore, since the plurality of processing units are arranged in a substantially U-shaped, arrangement, the length of the water tank is comparatively small and the photographic film processing apparatus has a compact construction, for example, a construction of about 250 mm in overall height, about 230 mm in width and about 200 mm in length.

Still further, the photographic film processing apparatus in the second embodiment may be provided with a shading hood or the like on the film receiving side thereof to enable the photographic film processing apparatus to be used easily in a well-lit room.

Although the invention has been described in its preferred forms with a certain degree of particularity, obviously many changes and variations are possible therein. It is therefore to be understood that the present invention may be practiced otherwise than as specifically described herein without departing from the scope and spirit thereof.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A photographic film processing apparatus comprising:

a water tank for containing fresh water; and at least one processing unit disposed within the water tank and comprising:

a pair of feed rollers disposed in close contact with each other;

a pair of delivery rollers disposed in close contact with each other and spaced apart from the pair of feed rollers;

a pair of sealing rollers disposed in close contact with both a top feed roller and a top delivery roller of said pair of feed rollers and said pair of delivery rollers, and both a bottom feed roller and a bottom delivery roller of said pair of feed rollers and said pair of delivery rollers, respectively; and a pair of support plates disposed on opposite sides of the pair of feed rollers, the pair of delivery rollers and the pair of sealing rollers and supporting the pair of feed rollers, the pair of delivery rollers and the pair of sealing rollers for rotation so that a liquid-tight processing chamber having a comparatively small capacity is defined by the circumferences of the pair of feed rollers, the pair of delivery rollers and the sealing rollers, and the inner surfaces thereof;

wherein respective bodies of the feed rollers and the delivery rollers are formed of elastic materials, respectively, one of the support plates is provided with a processing liquid inlet port opening into the processing chamber, and the other support plate is provided with a processing liquid outlet port opening into the processing chamber.

2. A photographic film processing apparatus according to claim 1, wherein a film guide member having a flat liquid passage having a slit-shaped inlet end and a slit-shaped outlet end is disposed within the processing chamber with the inlet end and the outlet end of the flat liquid passage thereof facing opposite to a contact line between the feed rollers and a contact line between the delivery rollers, respectively.

3. A photographic film processing apparatus comprising:

a water tank for containing fresh water; and a plurality of processing units disposed within the water tank and each comprising:

a pair of feed rollers disposed in close contact with each other;

a pair of delivery rollers disposed in close contact with each other and spaced apart from the pair of feed rollers;

a pair of sealing rollers disposed in close contact with both a top feed roller and a top delivery roller of said pair of rollers and said pair of delivery rollers, and both a bottom feed roller and a bottom delivery roller of said pair of feed rollers and said pair of delivery rollers, respectively, and a pair of support plates disposed on opposite sides of the pair of feed rollers, the pair of delivery rollers and the pair of sealing rollers and supporting the pair of feed rollers, the pair of delivery rollers and the pair of sealing rollers for rotation so that a liquid-tight processing chamber having a comparatively small capacity is defined by the circumferences of the pair of feed rollers, the pair of delivery rollers, the pair of sealing rollers, and the inner surfaces thereof;

wherein the pair of support plates are used as common support plates for all the plurality of processing units, respective bodies of the pair of feed rollers and the pair of delivery rollers are formed of elastic materials, respectively, one of the pair of support plates are provided with processing liquid inlet ports opening respectively into the processing chambers and the other support plate is provided with processing liquid outlet ports opening respectively into the processing chambers.

4. A photographic film processing apparatus according to claim 3, wherein a film guide member having a flat liquid passage having a slit-shaped inlet end and a slit-shaped outlet end is disposed within each of the processing chamber with the inlet end and the outlet end of the flat liquid passage thereof facing opposite to a contact line between the feed rollers and a contact line between the delivery rollers, respectively.

5. A photographic film processing apparatus according to claim 3, wherein the plurality of processing units are disposed in a substantially U-shaped arrangement so that a film can be fed downward to the first processing unit and the film can be delivered upward from the last processing chamber, and the respective outside diameters of the top feed roller, the top delivery roller and the top sealing roller are smaller than those of the bottom feed roller, the bottom delivery roller and the bottom sealing roller, respectively.

6. A photographic film processing apparatus according to claim 4, wherein the plurality of processing units are disposed in a substantially U-shaped arrangement so that a film can be fed downward to the first processing unit and the film can be delivered upward from the last processing chamber, and the respective outside diameters of the top feed roller, the top delivery roller and the top sealing roller are smaller than those of the bottom feed roller, the bottom delivery roller and the bottom sealing roller, respectively.

7. A photographic film processing apparatus according to claim 5, wherein the processing liquid inlet port and the processing liquid outlet port of each processing unit are connected to a circulating pump respectively by a supply tube and a return tube, and an air vent tank is connected to the supply tube or the return tube.

8. A photographic film processing apparatus according to claim 6, wherein the processing liquid inlet port and the processing liquid outlet port of each processing unit are connected to a circulating pump respectively by a supply tube and a return tube, and an air vent tank is connected to the supply tube or the return tube.

9. A photographic film processing apparatus according to claim 7, wherein the air vent tank is provided therein with a cathode plate for collecting silver ions by electrodeposition.

10. A photographic film processing apparatus according to claim 8, wherein the air vent tank is provided therein with a cathode plate for collecting silver ions by electrodeposition.

* * * * *